United States Patent [19]

Alznauer et al.

[11] Patent Number: 4,995,254

[45] Date of Patent: Feb. 26, 1991

[54] METHOD AND APPARATUS FOR ENSURING THE DIMENSIONAL ACCURACY OF A FRUSTO-PYRAMIDAL CAN BODY

[75] Inventors: Kurt Alznauer, Lauchringen, Fed. Rep. of Germany; Michael Baumgartner, Rekingen, Switzerland; Werner Boegli, Bergdietikon, Switzerland; Jürgen Brauer, Boniswil, Switzerland

[73] Assignee: Elpatronic AG, Zug, Switzerland

[21] Appl. No.: 474,470

[22] Filed: Feb. 2, 1990

[30] Foreign Application Priority Data

Feb. 16, 1989 [CH] Switzerland ..... 534/89

[51] Int. Cl.[5] ..... B21D 51/26

[52] U.S. Cl. ..... 72/342.1; 72/393

[58] Field of Search ..... 72/342, 393

[56] References Cited

U.S. PATENT DOCUMENTS

| | | | |
|---|---|---|---|
| 1,910,652 | 5/1933 | Taylor | 72/393 |
| 2,736,361 | 2/1956 | Kocks | 72/342 |
| 4,901,557 | 2/1990 | Schmidt . | |

*Primary Examiner*—Lowell A. Larson

*Attorney, Agent, or Firm*—McCormick, Paulding & Huber

[57] ABSTRACT

A method and an apparatus for ensuring the dimensional accuracy of a frusto-pyramidal can body (10). During the production of the body (10) this is partially heated by means of inductors in the vicinity of its base face in the region of its broader side faces (10*a*,10*b*), before the step in which it is formed into the pyramidal frustum. In this manner, a uniform reduction in the thickness of the sheet metal is achieved in the region of the base face of the pyramidal frustum during the widening operation.

14 Claims, 2 Drawing Sheets

Figure 1:
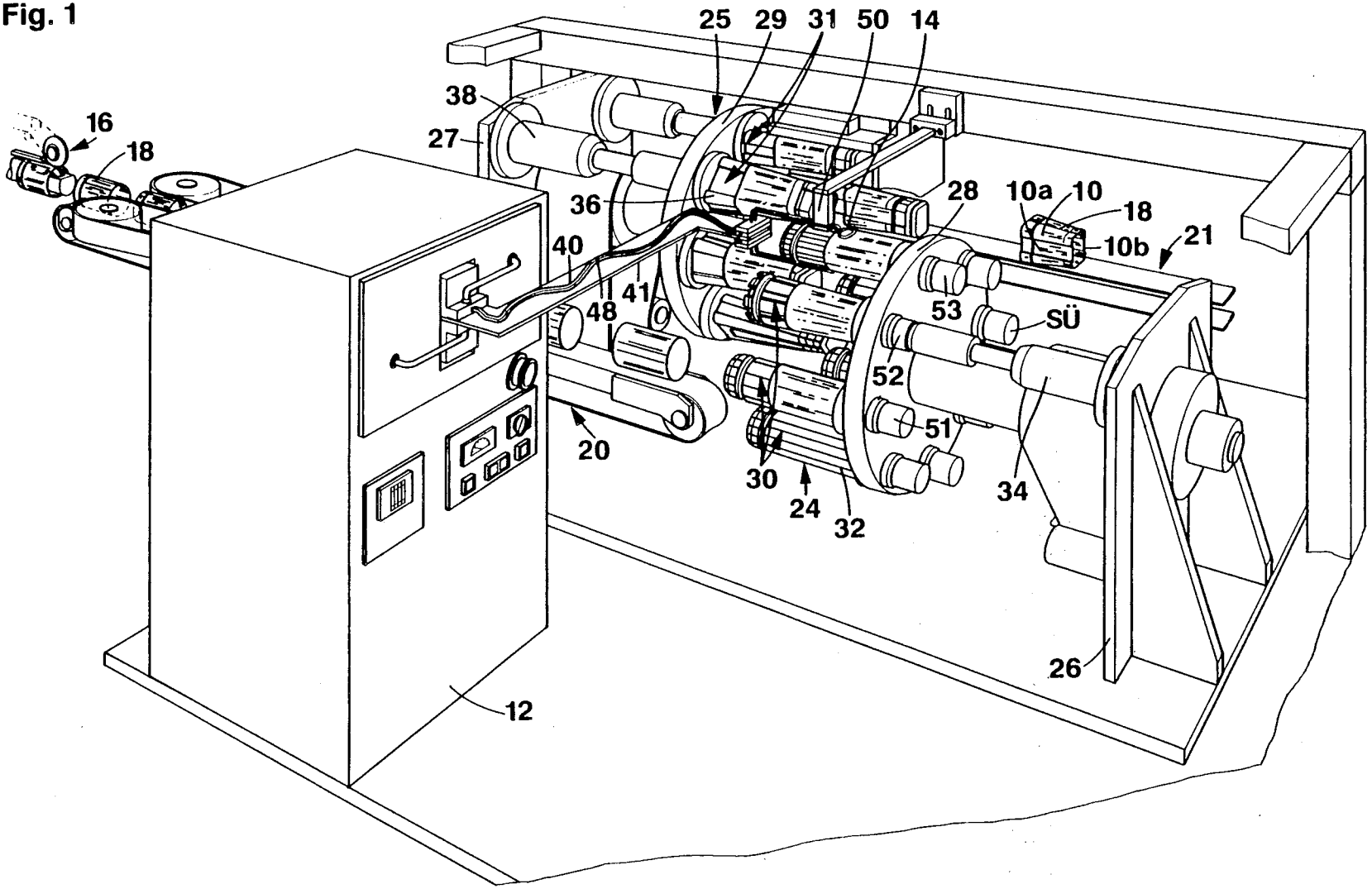

METHOD AND APPARATUS FOR ENSURING THE DIMENSIONAL ACCURACY OF A FRUSTO-PYRAMIDAL CAN BODY

The invention relates to a method of ensuring the dimensional accuracy of a frusto-pyramidal can body during the production of which a rectangular sheet-metal blank is cylindrical shaped, longitudinal-seam welded and then shaped into the frustum of a pyramid. In addition, the invention relates to an apparatus for carrying out the method.

The method and the apparatus are preferably used in a known method and a known apparatus for the production of frusto-pyramidal can bodies in accordance with U.S. Pat. No 4,901,557. In this known method, circular cylindrical bodies are formed from rectangular sheet-metal blanks by rounding and longitudinal-seam welding. In a first expanding operation, these bodies are widened into a tapered oval over their whole length. Then the bodies are shaped into the frustum of a pyramid in a second expanding operation. In order that frusto-pyramidal can bodies may result having end edges which are well suited for flange seaming on a cover and a bottom respectively, the bodies are stressed at their end marginal regions during the widening, in such a manner that these margin regions do not become wavy and can therefore be satisfactorily connected to a can cover and bottom respectively.

In cans such as are used to receive corned beef the specified size of the flange height is 3 mm. At the same time, the tolerance is ±0.1 mm. During the packing of corned beef, the frusto-pyramidal can body is folded over at the top and bottom, that is to say provided with the so-called hook flanges, round which the hook flanges of cover and bottom respectively are folded. Deviations beyond ±0.1 mm on the can body could not be compensated by the hook flanges of cover and bottom because these are bought from other suppliers as standard parts in finished form with sealing rubber already inserted or a sealing coating applied. Oversize or undersize at the ends of the can body can therefore lead to problems in the seaming operation and to leaks in the seamed connection.

The method and the apparatus which are known from U.S. Pat. No. 4,901,557 originating from the Applicants, are used on high-speed production lines which produce 150 can bodies per minute. It is true that an adequate dimensional accuracy is naturally likewise aimed at in this case but it is clear that in such high-capacity installations the said narrow flange-height tolerance of only ±0.1 mm cannot be adhered to in the optimum manner if the hardness of the sheet metal worked or other parameters should vary. At the very least, ensuring the dimensional accuracy would involve great expense because the mechanical gripping of the bodies during the widening operation always has to be adapted precisely to the parameters which influence the dimensional accuracy.

It is the object of the invention to provide a method and an apparatus for carrying it out whereby the dimensional accuracy of a frusto-pyramidal can body can be ensured in the optimum manner.

According to the invention, this problem is solved in a method of the kind mentioned at the beginning in that the body is heated before the shaping and, in an apparatus for carrying out the method on a machine with two shaping stages, of which the first stage, which receives cylindrically shaped, longitudinal-seam welded bodies and shapes them into a tapered oval, has at least one transfer station from which the bodies are transferred to the second stage which shapes the bodies frusto-pyramidally, in that at least one heat source is disposed before the transfer station of the first stage.

Can bodies of tin plate, that is to say of tinned sheet steel, are heated, in the course of this, to a temperature which in any case is below the melting temperature of the tin, that is to say below 231.85° C. In an experimental device, a temperature in the range from 60°-70° C. was measured. With a production output of 150 can bodies per minute, a standstill time of about 2/10ths of a second is available in which the body is heated to the above-mentioned temperature. As a result of this heating, the sheet metal of the body can be shaped more easily and as a result, the dimensional accuracy can be ensured more easily than in the known case described above.

Advantageous developments of the invention form the subject matter of the sub-claims.

In one arrangement, the heating is effected inductively and an inductor connected to a high-frequency generator is used as a heat source. The inductive heating offers the most practicable possibility of achieving the most favourable working temperature for the hot shaping of the sheet metal in the available short time of only about 2/10ths of a second. It is true that a radiant heat source, a flame or the like could also easily be used as a heat source but this would have to be very specially constructed in order that the necessary high heating speed could be achieved and the formation of scale and waste gases be avoided. In addition, the tools used for the shaping of the can bodies should not be heated themselves, so as not to endanger their service life. Inductive heating is therefore preferred.

The shaping of the can bodies is preferably effected in two steps, the body being shaped into a tapered oval in the first step and into a regular frustum of a pyramid, which is rectangular in cross-section with rounded side edges, in the second step. In this case, the method according to the invention is such that the heating is effected before the second step and after the first so that the sheet metal has the most favourable working temperature at the beginning of the second step.

This development of the invention is particularly advantageous wherein the body is only partially heated and the partial heating is effected in first component regions of the body which will later be in the two broader side faces of the frustum of a pyramid. The maximum shaping work is performed at the rounded side edges of the pyramidal frustum. The thickness of the sheet metal would decrease to a greater extent at these points than, for example, in the middle of the broader side faces, if this was not compensated by the partial heating.

In order to optimize further the ensuring of dimensional accuracy, the invention may also be developed so that the partial heating is effected in component regions of the body which will later be in the two narrower side faces and/or in the two broader side faces of the pyramidal frustum.

In a further development of the invention, the partial heating extends to component regions of the body which will later be between the rounded side edges of the pyramidal frustum, which are spaced apart from these and are situated closer to the base surface than to the top surface of the pyramidal frustum. Ensuring the dimensional accuracy can be further optimized as a result of this because the heating is effected in regions of the body, viewed over the circumference of the body at the base of the pyramidal frustum, where the shaping work is the least. The partial heating compensates for that so that the thickness of the sheet metal is reduced uniformly over the circumference of the body as a whole and the dimensional accuracy is even better ensured as a result.

The method and the apparatus according to the invention may be arranged so that the body is heated from the outside or from the inside. Heating from the outside is preferred at present because it is technically easier to realize since no special thermal insulation is necessary between heat source and expanding tool in this case. Experiments have shown that the time during which the body remains in its heating position is sufficiently short so that the expanding tools themselves are scarcely heated. The thermal energy remains in the can bodies which already leave the expanding tool again after about 2/10ths of a second.

If the apparatus according to the invention is used on a machine with two shaping stages of which the first shaping stage has at least one first expanding mandrel for the shaping of the bodies into a tapered oval, and the second shaping station has at least one second expanding mandrel with four segmental bars which can be expanded by a wedge and are provided with a radius at the outside, the apparatus according to the invention is arranged so that disposed before the transfer station of the first shaping stage, from which the bodies are transferred to the second shaping stage, are two inductors which, when the first expanding mandrel is moved into the heating station, are situated diametrically opposite one another and are spaced apart from the peripheral surface of the first expanding mandrel. This should be the simplest arrangement of the apparatus according to the invention in order to effect the partial heating in component regions which will later be in two opposite side faces of the pyramidal frustum.

The apparatus according to the invention is preferably arranged so that the inductors are flat loops which are held fixed and which are substantially narrower than the height of the bodies, and that the bodies can be moved cyclically into the heating position between the inductors.

This renders it possible, in a further development of the apparatus according to the invention, to supply the inductors continuously with high-frequency alternating current.

Finally, the apparatus according to the invention can be arranged so that the inductors are adjustable at least in the direction of the height and of the circumference of the bodies, so that the best heating position can be adjusted in a simple manner.

Several examples of embodiment of the invention are described in more detail below with reference to the drawings.

Figure 2:
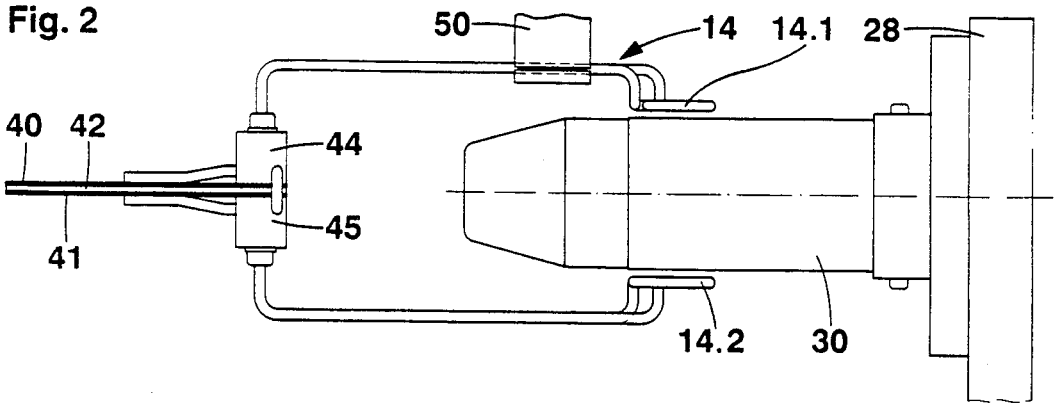
Figure 3:
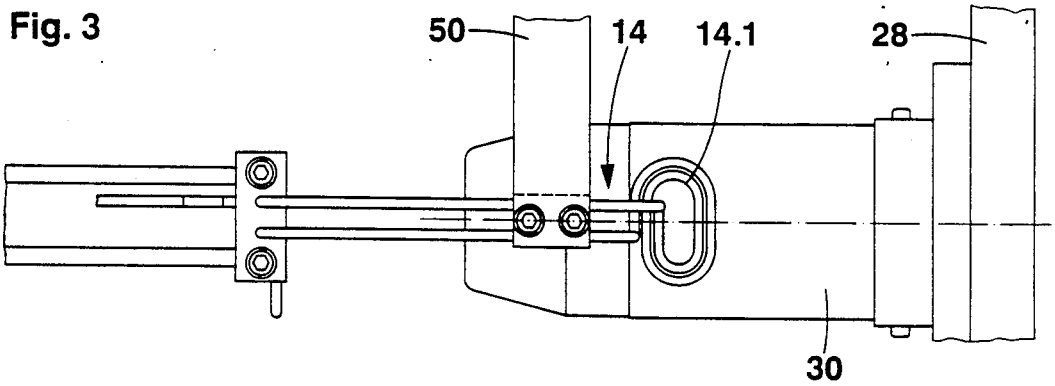
Figure 6:
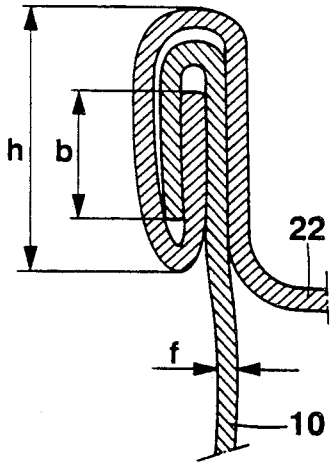
Figure 4:
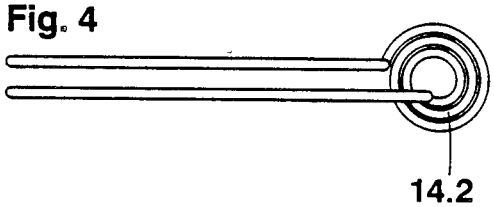
Figure 5:
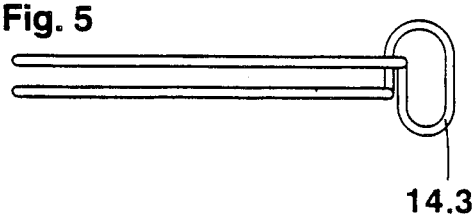

FIG. 1 shows a machine for the production of frusto-pyramidal can bodies, provided with apparatus according to the invention, FIG. 2 shows part of a shaping stage of the machine according to FIG. 1 to illustrate the arrangement of inductors and expanding tool, FIG. 3 shows the arrangement according to FIG. 2 in plan view, FIGS. 4 and 5 show two further forms of embodiment of an inductor, and FIG. 6 shows a cross-sectional view of a flanged seam connection.

FIG. 1 shows a general view of a machine for producing frusto-pyramidal bodies 10 for cans to contain corned beef or the like. The machine is provided with a device for the partial inductive heating of the bodies 10, which device consists of a high-frequency generator 12 and two inductors 14 which are connected to this and of which only the upper one is visible in FIG. 1. The construction of the machine is only described here to the extent necessary for an understanding of the invention. A more detailed description of the machine will be found in U.S. Pat. No. 4,901,557.

A rectangular sheet-metal blank, which has been shaped cylindrically, is welded with a longitudinal seam 18 in a body welding machine 16. The cylindrically shaped, longitudinally-seam welded bodies 10 are supplied to the machine by a longitudinal conveyor 20. On leaving the machine, a finished, frusto-pyramidal body 10 has the shape which can be seen at the top right in FIG. 1. The pyramidal frustum has rounded longitudinal edges. Two recesses directed longitudinally in its broader side faces are of no interest. The longitudinal seam 18 lies in the middle of one of the two narrower side faces of the finished body 10. In the state shown at the top right in FIG. 1, the body 10 goes to the corned beef manufacturer who provides it with a flange (so-called hooked flange) at each of the two ends so that bottom and cover can be secured to the body.

FIG. 6 shows as a detail a cross-sectional view of such a seamed connection between the body 10 and a cover 22. In the case described here, the thickness f of the sheet metal is usually 0.25 mm. The specified height h of the flange is 3 mm, the tolerance being $\pm 0.1$ mm. The minimum size of the dimension b is 1.1 mm with a tolerance of 0.2 mm. It is clear that with such narrow tolerances for the connection, the dimensional accuracy of the can body 10 must be ensured because deviations in dimension lying outside the tolerance cannot be compensated by the hooked flanges of the cover which is bought as a standard part from other suppliers. The apparatus described in more detail below, which consists of the high-frequency generator 12 and the inductors 14, serves to ensure this dimensional accuracy.

The longitudinal conveyor 20 conveys the bodies 10 at short distances one behind the other into a first shaping stage 24 of the machine. The first shaping stage 24 comprises a first rotary table 28 which is secured to a pedestal 26 and which is rotatable about a horizontal axis parallel to the longitudinal conveyor 20. Eight parallel expanding mandrels 30 are secured with equal spacing to the first rotary table 28. The first rotary table 28 can be rotated cyclically through 45° each time. Each expanding mandrel 30 comprises a ring of pivotable segmental bars 32 which can be expanded by means of an expanding cylinder 34 in such a manner that a body 10 placed thereon is widened into a tapered oval shape. The greatest widening takes place at the end of the body 10 which is adjacent to a second shaping stage 25.

The second shaping stage 25 comprises a second rotary table 29 which is secured to a pedestal 27 and which is likewise rotatable about a horizontal axis which is parallel to the axis of rotation of the first rotary table 28.

Secured to the second rotary table 29, parallel to its axis of rotation, with equal pitch, are eight expanding mandrels 31. The second rotary table 29 is rotatable cyclically in synchronism with the first rotary table 28 and after each rotary cycle an expanding mandrel 31 is aligned with an expanding mandrel 30. Each expanding mandrel 31 has four segmental bars 36, the outer radius of which corresponds to the rounding of the side edges of the frusto-pyramidal body 10. The segmental bars 36 can be expanded by means of an expanding cylinder 38.

After each cyclic movement of the two rotary tables 28,29 one of the expanding mandrels 30 is in alignment with the longitudinal conveyor 20 in order to receive from this a cylindrically shaped body 10. This station of the first shaping stage is designated by S1 in FIG. 1. In a station S2 at a pitch of 45° therefrom, the widening of the body 10 into a tapered oval is effected. After that, the first rotary table 28 reaches a station designated by S3 in which the body 10 is heated in a manner described below. Then the first rotary table 28 reaches a transfer station SÜ which is at a pitch of 180° from the station S1. There the expanding mandrel 30 which carries the heated body 10 shaped into a tapered oval stands axially opposite one of the expanding mandrels 31 fitted to the second rotary table 29. A transfer conveyor that is not illustrated transfers this body 10 from the station SÜ into the station situated opposite this on the second rotary table 29. The heated body 10 shaped into a tapered oval and now pushed onto a expanding mandrel 31 reaches a station at a pitch of 45° during the next cycle of the second rotary table 29, in which station the expanding mandrel 31 shapes the body 10 into the frustum of a pyramid. Finally, this expanding mandrel 31 reaches a last station where the body 10 is removed and transferred to a longitudinal conveyor 21. Thus eight frusto-pyramidal can bodies 10 are produced in the course of one revolution of the rotary tables 28,29.

The high-frequency generator 12 has a high frequency output of 5 kW in continuous operation and a working frequency of about 700 kHz. Leading from the output side of the high-frequency generator 12 to terminal blocks 44 and 45 respectively are two busbars 40,41 between which there is provided an insulation 42. Connected to these terminal blocks are two inductors 14 which lead, as a hollow copper conductor from the terminal block 44 to a loop-shaped portion 14.1, which forms the actual inductor, back to and past the terminal blocks 44,45 to a further loop-shaped portion 14.1 and from there back to the terminal block 45. Connected to the terminal blocks 44,45 are coolant conduits 48 which are visible in FIG. 1 and which are connected, in the terminal block 44, to the outgoing copper conductor and, in the terminal block 45, to the incoming copper conductor respectively. When an expanding mandrel 30 has been moved into the heating station 53, the loop-shaped parts 14.1 and 14.2 of the inductors 14 are situated diametrically opposite one another and are spaced apart from the peripheral surface of the expanding mandrel 30. The flat loops 14.1,14.2 are considerably narrower than the height of the bodies 10. The inductors 14 are so arranged in relation to the expanding mandrel 30 that, when a body 10 is in the heating position, they are above the middle of the broader sides of the body. Each inductor is adjustable at least in the direction of the height and of the circumference of the body 10, this function being served by a holder 50 to which the upper inductor 14 is detachably secured in the example of embodiment illustrated. The holder 50 is adjustable perpendicular to the plane of the drawing in FIG. 2.

FIGS. 4 and 5 show further flat loops 14.2 and 14.3 respectively as further modified embodiments of the inductors 14.

During the widening operation on the second rotary table 29, the body 10 would be drawn in somewhat at its left-hand end in the region of the rounded corners for the reasons mentioned at the beginning, that is to say a projecting convex portion would be obtained between the rounded corners and could hamper the flanging if its size were outside the tolerance of ±0.1 mm. This drawing in of the corners can admittedly be counteracted mechanically but this is possible more effectively and simply by the partial heating of the bodies 10 described here.

The high-frequency generator 12 used was the type IG 111 W of Messrs Plustherm AG, CH-5401 Baden, with the following technical data:

| | |
|---|---|
| High-frequency output during continuous operation | 5 kW |
| Working frequency | about 700 kHz |
| High-frequency power adjustable under load | 25 . . . 100% |
| High-frequency power during intermittent operation (30% operating time) | 6 kW |
| Power consumption | |
| under full load | about 11 kW |
| under no-load (without high frequency) | about 0.4 kW |
| Mains connection | |
| Voltage, 3-phase with | 380/220 V |
| neutral conductor Frequency | 50 Hz |
| Permissible voltage fluctuations (Other voltages and frequencies also possible) | +5/−10% |
| Cooling water supply system | |
| Consumption | 8 l/min at +20° C. |
| Pressure | 3 to 6 kg/cm$^2$ |

We claim:

1. A method of ensuring the dimensional accuracy of a frusto-pyramidal can body produced from a rectangular sheet metal blank that is shaped cylindrically and longitudinally seam welded, comprising the steps of: shaping the seam welded can body into a tapered oval body; and then shaping the tapered oval body into a regular frustum of a pyramid which is rectangular in cross section with rounded side edges; and heating the can body after the step of shaping the tapered oval body and before the step of shaping the frustum of a pyramid.

2. A method according to claim 1, characterized in that the heating is effected inductively.

3. A method according to claim 1, characterized in that the step of heating is limited to selected regions of the can body.

4. A method according to claim 3, characterized in that the step of heating is effected in regions of the body which are later to become two broader side faces of the pyramidal frustum.

5. A method according to claim 3, characterized in that the step of heating is effected in two regions of the body which are later to become two narrower side faces of the pyramidal frustum.

6. A method according to claim 3, characterized in that the the step of heating extends to component regions of the body which are later to be located between the rounded side edges of the pyramidal frustum, are spaced apart from the rounded side edges and are situated closer to the base than to the top of said frustum.

7. A method according to claim 1, characterized in that the body is heated from a heating source located outside the can body.

8. An apparatus for ensuring the dimensional accuracy of a frusto-pyramidal can body made from a cylindrically shaped, longitudinal-seam welded can body comprising: two shaping stages, of which the first stage receives the cylindrically shaped, longitudinal-seam welded bodies and shapes them into tapered oval bodies, and has at least one transfer station (SÜ) from which the bodies are transferred to the second stage which shapes the bodies into frusto-pyramidal bodies, and at least one heat source disposed before the transfer station (SÜ) of the first stage.

9. An apparatus according to claim 8, characterized in that the heat source is an inductor (14) connected to a high-frequency generator (12).

10. An apparatus according to claim 9, wherein the first shaping stage has at least one first expanding mandrel for the shaping of the bodies into tapered ovals and wherein the second shaping stage has at least one second expanding mandrel with four segmental bars which can be expanded and are provided with a radius at the outside, characterized in that disposed at a heating position for the bodies in front of the transfer station (SÜ) of the first shaping stage are two heat sources in the form of indicators which, when a body is moved into the heating position, are situated diametrically opposite one another and are spaced apart from the body.

11. An apparatus according to claim 10, wherein the expanding mandrels of both shaping stages are secured to first and second axially adjacent rotary tables, characterized in that the inductors are flat loops which are held fixed and which are considerably narrower than the height of the bodies, and that the bodies can be moved by means of the first rotary table cyclically into the heating position between the inductors.

12. An apparatus according to claim 11, characterized in that the inductors (14) are so arranged in relation to the first expanding mandrel (30) that, when the bodies (10) are in the heating position, the inductors are above the middle of their broader sides.

13. An apparatus according to claim 9, characterized in that the inductor (14) is supplied continuously with high-frequency alternating current.

14. An apparatus according to claim 9, characterized in that the inductors (14) are adjustable at least in the direction of the height and of the circumference of the body (10).

* * * * *